US005541720A

United States Patent [19]

Haneda

[11] Patent Number: 5,541,720

[45] Date of Patent: Jul. 30, 1996

[54] COLOR IMAGE FORMING APPARATUS WITH A PROCESS CARTRIDGE AND A COLOR DEVELOPING UNIT

[75] Inventor: Satoshi Haneda, Hachioji, Japan

[73] Assignee: Konica Corporation, Tokyo, Japan

[21] Appl. No.: 313,908

[22] Filed: Sep. 28, 1994

[30] Foreign Application Priority Data

Oct. 14, 1993 [JP] Japan ..... 5-257241
Nov. 18, 1993 [JP] Japan ..... 5-289434

[51] Int. Cl.[6] ..... G03G 15/01

[52] U.S. Cl. ..... 355/326 R; 355/210; 355/327

[58] Field of Search ..... 355/326 R, 327, 355/210, 211, 200

[56] References Cited

U.S. PATENT DOCUMENTS

| | | | |
|---|---|---|---|
| 5,036,367 | 7/1991 | Haneda et al. | 355/326 R |
| 5,287,161 | 2/1994 | Matsuo et al. | 355/326 R |
| 5,327,208 | 7/1994 | Matsuo et al. | 355/326 R |
| 5,402,212 | 3/1995 | Ito et al. | 355/210 |

FOREIGN PATENT DOCUMENTS

| | | | |
|---|---|---|---|
| 411825 | 2/1991 | European Pat. Off. | 355/210 |
| 2-118673 | 5/1990 | Japan | 355/210 |
| 2-120870 | 5/1990 | Japan | 355/210 |
| 2-144556 | 6/1990 | Japan | 355/210 |
| 3-107169 | 5/1991 | Japan | 355/210 |

*Primary Examiner*—Matthew S. Smith
*Attorney, Agent, or Firm*—Finnegan, Henderson, Farabow, Garrett & Dunner, L.L.P.

[57] ABSTRACT

A color image forming apparatus which includes: an enclosure body having an upper body and a lower body; a photoreceptor for forming a toner image on its surface; a charger for charging the surface of the photoreceptor; a laser beam generator for forming a patent image on the surface charged by the charger; a black developer for forming a black toner image; in which the photoreceptor and the black developer form a process cartridge and the process cartridge is detachablly accommodated in the upper body; a color developer for forming a color toner image; in which the color developer includes a toner replenishing port and a toner hopper, and the color developer is capable of being detached from the process cartridge so that the color toner is supplied to the toner hopper through the toner replenishing port; a transferor for transferring the black toner image and the color toner image from the surface of the photoreceptor to the recording medium; and a support shaft member for pivotally supporting the upper body and the lower body so that the upper body has a closed position in which the upper body is coupled with the lower body by a coupling member so as to enable the color image forming apparatus for forming a color image and an open position in which the process cartridge is moved upward so as to create an open space between the transferor and the photoreceptor.

11 Claims, 12 Drawing Sheets

COLOR IMAGE FORMING APPARATUS WITH A PROCESS CARTRIDGE AND A COLOR DEVELOPING UNIT

BACKGROUND OF THE INVENTION

The present invention relates to a color image forming apparatus in which a photoreceptor is used as an image retainer for forming a toner image on its surface, and more particularly relates to an improvement in the workability of jam clearance and toner replenishment by replacing a process cartridge.

In a color image forming apparatus for which a photoreceptor is used, a plurality of developing units are disposed around the photoreceptor, that is, four developing units including toners of Y, M, C and black are respectively disposed close to the circumferential surface of the photoreceptor. Development operation is conducted in such a manner that the toners of primary colors of Y, M and C are superimposed when the photoreceptor is rotated by 3 revolutions (by 4 revolutions when black toner is included). Then the formed toner image is transferred onto a transfer sheet and thermally fixed by a fixing unit.

A photoreceptor drum or photoreceptor belt, which is an image forming body, composes a process cartridge together with a cleaner, charger, discharger and developing unit. In the case where a problem has occurred in the process of operation, the process cartridge is taken out from the image forming apparatus, so that inspection and jam clearance can be easily carried out. In spite of the above construction, inspection and jam clearance can not be competently carried out in the image forming apparatus of the prior art.

Further, the image forming apparatus of the prior art has the following disadvantages:

When the process cartridge and a unit composed of developing units are engaged with the image forming apparatus after they have been disengaged from it, they can not be smoothly connected with a drive system, and further it is difficult to conduct maintenance and jam clearance.

SUMMARY OF THE INVENTION

It is an object of the present invention to provide a color image forming apparatus in which the above problems of the prior art are solved.

The above object can be solved by one of the following technical means (1) to (9).

(1) A color image forming apparatus comprising an image retainer and a plurality of developing units, wherein the black developing unit and the image forming body are included in a process cartridge, and the Y, M, C color developing units are separated from the process cartridge and preferably formed into a color developing unit, and a transfer region is opened and the color developing units are attached to and detached from the image forming apparatus when the process cartridge is moved upward.

(2) The color image forming apparatus according to item (1), wherein the color developing units are moved and withdrawn from a developing position being linked with an upward movement of the process cartridge.

(3) The color image forming apparatus according to one of items (1) and (2), wherein a toner replenishing port is provided at an upper position of each color developing unit.

(4) The color image forming apparatus according to one of items (1) to (3), wherein a toner replenishing port is provided at an upper position of the process cartridge.

(5) A color image forming apparatus comprising a process cartridge composed of an image retainer and developing units of Y, M, C and back, wherein toner is replenished to the black developing unit through a replenishing port provided at an upper position under the condition that the process cartridge is attached to the image forming apparatus, and also toner is replenished to the Y, M and C color developing units through replenishing ports provided at upper positions of the color developing units under the condition that the developing units are withdrawn from the image forming body.

(6) A color image forming apparatus comprising a process cartridge composed of an image forming body and developing units of Y, M, C and back, wherein the Y, M and C color developing units are capable of being withdrawn from or attached to or detached from the image forming apparatus only under the condition that the process cartridge is assembled to the image forming apparatus.

(7) The color image forming apparatus according to item (6), wherein the Y, M and C color developing units are incapable of being withdrawn from or attached to the image forming apparatus even when it is attempted to attach the Y, M and C color developing units after they have been detached from the color image forming apparatus.

(8) The color image forming apparatus according to item (6), wherein the process cartridge is incapable of being detached from the color image forming apparatus under the condition that the Y, M and C color developing units are withdrawn from the image forming body in the process cartridge.

(9) The color image forming apparatus according to item (6), wherein the process cartridge is incapable of attaching to the color image forming apparatus unless the Y, M and C color developing units are fixed to the process cartridge in the case where the Y, M and C color developing units are attached to the process cartridge detached from the color image forming apparatus.

The image forming apparatus according to the first and the second embodiments of the present invention is constructed in the following manner:

A process cartridge to which an image forming body and a black developing unit are assembled is attached to an upper body, and color developing units of Y, M and C are attached to a lower body. The upper body is capable of being opened upward with respect to the lower body. Since three developing units out of four are attached to the lower body being integrated into one unit, the upper body can be widely opened upward with a low lifting force in the case of jam clearance or inspection. Due to the foregoing, jam clearance, inspection and member replacement can be easily conducted, and toner can be easily replenished to the black, Y, M and C developing units in a wide open space. When necessary, maintenance and inspection can be easily conducted under the condition that the process cartridge is disengaged from the upper body and the color developing units are disengaged from the lower body in the same direction. Since attachment and detachment can be conducted in one direction, they are easily and positively connected with the drive system. It is preferable that the Y, M and C color developing units are independently or integrally assembled into a color developing unit. Since the space is widely opened, a shading device for shading the image forming body from light sent from the outside can be easily provided.

The color image forming apparatus according to the third embodiment is constructed in the following manner:

A process cartridge to which at least an image forming body and a black developing unit are assembled and a unit by which the Y, M and C developing units are detachably provided in the process cartridge are movably attached to the upper body. Therefore, in the case of the occurrence of jam, the upper body is opened from the lower body so as to positively and easily solve the problem. Concerning the replenishment of toner, black toner is replenished from an upper position, and each of Y, M and C toners is replenished from an upper position under the condition that the Y, M and C developing units are withdrawn from the image forming body to the right. It is preferable that the Y, M and C color developing units are independently or integrally assembled into a color developing unit.

The color image forming apparatus according to the fourth embodiment is constructed in the following manner:

Only when a process cartridge of which the construction is the same as that described in the third embodiment is attached to the image forming apparatus, it is possible to attach and detach the Y, M and C color developing units and it is also possible to withdraw the Y, M and C color developing units from the image forming body. When the cartridge is detached from the upper body, the Y, M and C developing units are incapable of being detached from the process cartridge. In the case where the Y, M and C developing units are attached to the detached process cartridge, the process cartridge can not be attached to the image forming apparatus main body. Under the condition that the Y, M and C developing units are withdrawn in the attached process cartridge, the process cartridge can not be detached from the upper body. In the case where the Y, M and C color developing units are attached to the detached process cartridge, the process cartridge can not be attached to the upper body unless the Y, M and C developing units are fixed to the process cartridge. Due to the foregoing, each developing unit is prevented from being disengaged from the process cartridge. It is possible that the Y, M and C color developing units are independently or integrally assembled into a color developing unit.

BRIEF DESCRIPTION OF THE DRAWINGS

FIG. 12(*b*) is a sectional side view showing a shading condition of the photoreceptor belt when the color developing units are detached.

FIG. 13(*b*) is a sectional side view showing a shading condition of the photoreceptor belt when the color developing units are detached.

DETAILED DESCRIPTION OF THE INVENTION

With reference to the accompanying drawings, the first embodiment of the present invention will be explained below.

Figure 1:
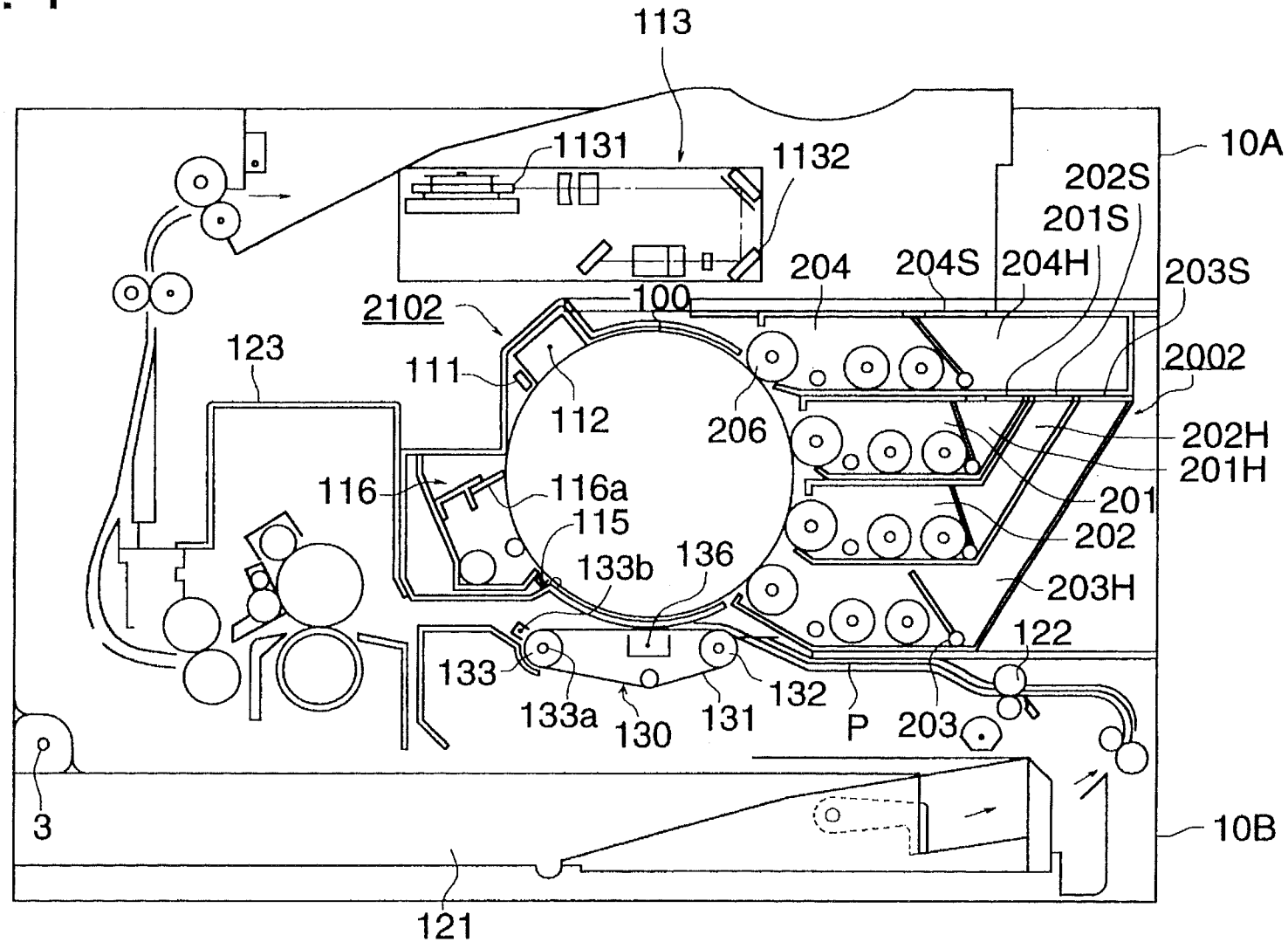
FIG. 1 is a sectional side view of the first embodiment of the color image forming apparatus of the present invention.

FIG. 1 is a view showing an example of the color image forming apparatus of the present invention.

In the drawings, numeral 100 is a photoreceptor drum that is an image retainer. The photoreceptor drum 100 is coated with an OPC photoreceptor and rotated clockwise. In this case, the photoreceptor drum 10 is connected to ground. Numeral 112 is a charger which is disposed on the circumferential surface of the photoreceptor drum 100. Before electric charging is conducted by the charger 112, the circumferential surface of the photoreceptor drum is electrically discharged when the circumferential surface is exposed to light emitted by PCL 111 in which light emitting diodes are used. This discharging operation is conducted for erasing the hysteresis of the photoreceptor.

After the photoreceptor has been uniformly charged, image exposure is conducted by the image exposure means 113 in accordance with image signals. The image exposure means 113 includes a light source (not shown) in which a laser diode is used, rotational polygonal mirror 1131, fθ lens, and reflection mirrors 1132. A beam of light emitted by the light source passes through the polygonal mirror 1131 and fθ lens. Then an optical path of the beam of light is bent by the reflection mirrors 1132, so that optical scanning is conducted, and a latent image is formed on the photoreceptor drum 100 when it is rotated (subsidiary scanning). In this example, exposure is conducted on the image portion, and then a reversal latent image is formed.

Around the photoreceptor drum 100, there are provided developing units 201, 202, 203, 204 respectively including developer composed of carrier and toners of yellow (Y), magenta (M), cyan (C) and black (K). First of all, development of the first color is conducted by the developing sleeve 206 which includes a magnet and rotates while developer is held on its circumferential surface. Developer includes: carrier particles, the cores of which are made of ferrite, and the cores are coated with insulating resin; and toner particles mainly made of polyester, to which pigment, charging control agent, silica and titanium oxide are added. A layer of developer formed on the developing sleeve 206 is regulated by a layer forming means, so that the thickness of the developer layer is controlled,and developer is conveyed to the developing region.

In the developing region, a gap formed between the developing sleeve 206 and photoreceptor drum 100 is larger than the layer thickness of developer, that is, the gap is formed to be DSD- A bias is impressed in the gap. Therefore, toner particles are released from carrier particles by the action of this bias voltage. In this way, the latent image is made to be visual, that is, reversal development is conducted.

After the first color image has been made to be visual, the image formation process of the second color is started. Therefore, the photoreceptor drum is uniformly charged by the scorotron charger 112 again, and then a latent image is formed by the image exposure means 113 in accordance with the second color image data. At this time, discharging operation is not conducted by PCL 111 in order to prevent the toner particles of the first color deposited on the image portion from scattering. Because the toner particles of the first color are scattered when the electric potential is suddenly lowered.

Image exposure is conducted on the circumferential surface of the photoreceptor drum so as to optically discharge, and in the optically discharged portion on the circumferential surface of the photoreceptor drum 100 where the first color image is not formed, the same latent image as that of the first color is formed and developed. In a portion where the first color image exists and development is conducted again, a latent image is formed by the action of exposure light which is shielded by the toner of the first color and also by the action of an electric charge of toner. Accordingly, development is conducted in accordance with a potential difference of the bias, so that the toner deposition amount is lowered. Therefore, masking processing for correcting the image exposure amount is conducted on the image data.

With respect to the third and fourth colors, the same image formation process as that of the first color is carried out, and a visual image of four colors can be formed on the circumferential surface of the photoreceptor drum 100.

On the other hand, the recording sheet P fed from the sheet feed cassette 121 by the sheet feed mechanism 122 is sent to the transfer region by the transfer belt device 130 in which the transfer belt 131 is provided. In this way, a multi-color image formed on the circumferential surface of the photoreceptor drum 100 is transferred onto the transfer sheet P all at once.

The transfer belt 131 is composed of an endless rubber belt, the thickness of which is 0.4 to 1.0 mm, and the resistance of which is $10^6$ to $10^{14}$ Ω.cm. The endless rubber belt includes a base made of urethane rubber, and a layer made of FLC which is provided on the surface of the base. This transfer belt 131 is provided between the support rollers 132 and 133. The transfer sheet P advances to a nip portion (transfer region) formed between the photoreceptor drum 100 and the transfer belt 131. Then a transfer electric field is given from the reverse side of the transfer belt 131 by the action of the corona discharger 136. In this way, the multi-color image is transferred onto the transfer sheet P.

After the transfer sheet P has been separated from the surface of the photoreceptor drum 100, a discharge unit **133*b* subjects the transfer sheet P to corona discharge while a shaft 1333 in which the shaft of the support roller 133 on the downstream side of the transfer belt 131 functions as an opposed electrode. The recording sheet P is separated from the transfer belt 131 after the discharge or while the discharge is being conducted. While the multicolor image is being formed, the transfer belt 131 of the transfer belt unit 130 is separated from the photoreceptor drum 100 while the transfer belt 131 is rotated around the shaft 133*a* of the support roller 133** on the downstream side.

After the transfer sheet P on which the multi-color image is formed has been separated from the transfer belt unit 130, it is conveyed to the fixing unit 123 composed of 2 press rollers, wherein at least one of them is provided with a heater attached inside of the roller. When the recording sheet P is given heat and pressure by the press rollers, the toner deposited on the recording sheet P is fused so that the toner is fixed onto the recording sheet P. After that, the transfer sheet P is discharged outside of the apparatus.

The residual toner on the circumferential surface of the photoreceptor drum 100 is subjected to the discharging operation by the discharger 115 for which an AC corona discharger is used. Then the residual toner is scraped off by the cleaning blade **116*a* made of rubber in the cleaning unit 116**. The scraped toner is discharged from the apparatus by means of a screw, or alternatively the scraped toner is stored in the apparatus.

After the residual toner has been removed, the photoreceptor drum 100 is exposed to light by the action of the PCL 111, and then it is uniformly charged by the scorotron charger 112. Then the next image formation cycle starts. While a multi-color image is being formed, the cleaning blade **116*a* is separated from the surface of the photoreceptor, and the AC discharging operation to be conducted by the discharger 115** is maintained in an OFF-condition.

As illustrated in the sectional side views of FIGS. 2, 6, 7, 8, 9, 10 and 11, in this example, the image forming apparatus is divided into an upper 10A and a lower body 10B. The upper body 10A can be opened upward pivotally about a support shaft 3 so that the upper body 10A is separated from the lower body 10B.

Figure 2:
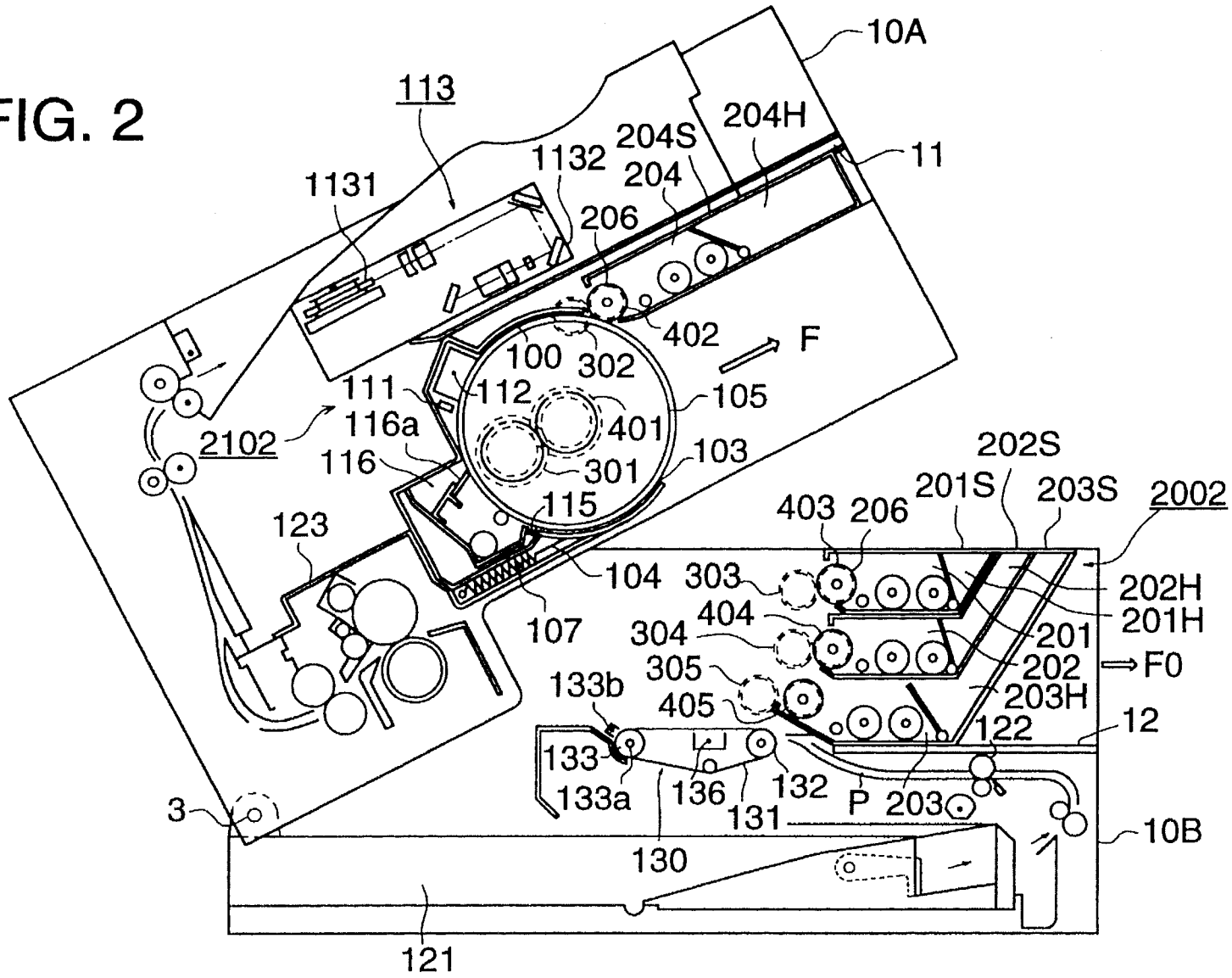
FIG. 2 is a sectional side view showing an open condition of the first embodiment of the color image forming apparatus of the present invention.

As illustrated in FIG. 2, in the first embodiment, there are provided a process cartridge 2102 and a fixing unit 123 in the upper body 10A. In this case, the process cartridge 2102 includes: an image exposure means 113, photoreceptor drum 100, black developing unit 204, toner hopper 204H of the developing unit 204, toner replenishing port 204S, charger 112, PCL discharger 111, AC discharger 115, cleaning section 116, shading curtain 104 of the photoreceptor drum 100, and opening and closing mechanism of the shading curtain 104. The process cartridge 2102 is moved along a guide rail 11 in the direction of arrow F shown in the drawing, so that the process cartridge 2102 can be attached to and detached from the upper body 10A.

In the lower body 10B, there is provided a color developing unit 2002 in which the following components are integrally assembled into one unit: a supply unit 121 for supplying transfer sheets P, conveyance roller 122 for conveying the transfer sheet P, corona discharger transfer 136, transfer belt 131 surrounding the corona discharger 136, guide rollers 132, 133 for the transfer belt 131, discharge unit **133*b* for the transfer belt 131, developing units 201, 202, 203 of Y, M and C, toner hoppers 201H, 202H, 203H for replenishing toner to the developing units, and replenishing ports 201S, 202S, 203S of the toner hoppers. In this construction, the color developing unit 2002 is capable of sliding along the guide rail 12 in the direction of FO, so that the color developing units can be attached to and detached from the lower body 10B. As described above, the upper and lower bodies 10A and 10B are widely opened, and the process cartridge 2102 attached to the upper body and the color developing unit 2002 attached to the lower body 10**B can be detached approximately in the same direction, so that the operation is simple and easy.

Although the fixing unit 128 shown in the drawings is attached to the upper body 10A, it is possible to attach the fixing unit 128 to the lower body 10B rather than the uppper body 10A.

As illustrated in FIG. 2, in the color image forming apparatus constructed in the manner described above, under the condition that the upper body 10A is fully opened from the lower body 10B, toner can be easily replenished to each of the hoppers of the black developing unit 204 and the color developing unit 2002. In this case, the photoreceptor drum 100 of the process cartridge 2102 is released from the color developing unit 2002 and exposed to light sent from the outside of the apparatus, so that the photoreceptor drum 100 is deteriorated. In order to prevent the deterioration of the photoreceptor drum 100, as shown in the perspective view of FIG. 3, the side view of FIG. 4 and the front view of FIG. 5, there are provided a rotational disk 105 concentrically provided on both sides of the photoreceptor drum 100 for driving a shading curtain, a shading curtain end guide bar 103 attached to the rotational disk 105 and a spring 107 pushing in the opening direction. By the action of the above components, the shading curtain 104 can be opened and closed covering the circumferential surface of the photoreceptor drum 100. In accordance with the reception of an opening release signal of the process cartridge 2102, the rotational disk 105 is rotated counterclockwise and locked at a closing position under the condition that the cartridge 2102 is attached to the upper body 10A, a closing signal for closing the upper body 10A to the lower body 10B is received, so that the disk 105 is unlocked and rotated clockwise. In this way, the shading curtain 104 of which the fore end is attached to the disk is opened. As described above, the process cartridge 2102 and the color developing unit 2002 are attached to and detached from the apparatus along the guide rails 11 and 12 (respectively), rail 11, 12, so that maintenance and jam clearance can be easily and positively carried out. When the cartridge and unit are attached to the apparatus, as shown in the sectional side view of FIG. 2, drive gears 301, 302, 303, 304, 305 provided in the upper and lower bodies 10A, 10B can be simply and positively connected to and disconnected from idle gears 401, 402, 403, 404, 405 provided in the cartridge and unit.

Next, with reference to the sectional side views of FIGS. 7 and 8, the second embodiment will be explained as follows. In this case, the components described in the first embodiment are assembled to the process cartridge 2103. Further, the developing units of Y, M and C may be assembled to the process cartridge 2103 in the form of the color developing unit 2002. However, as shown in the sectional side view of FIGS. 10 and 11, each of the Y, M and C developing units may be individually attached to and detached from the apparatus.

Figure 8:
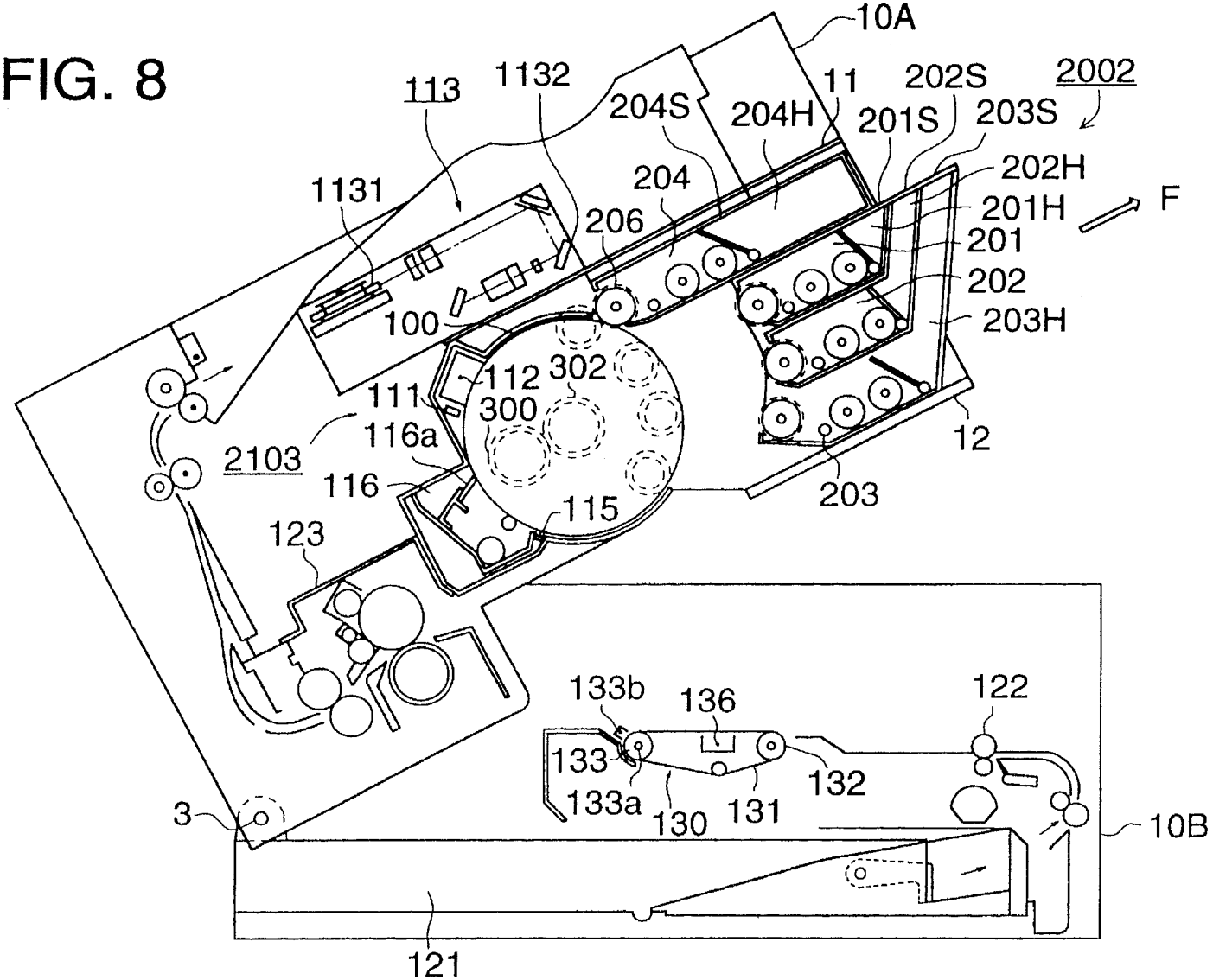
FIG. 8 is a sectional side view showing a condition in which the color developing unit is moved to a toner replenishing position in FIG. 7.
Figure 9:
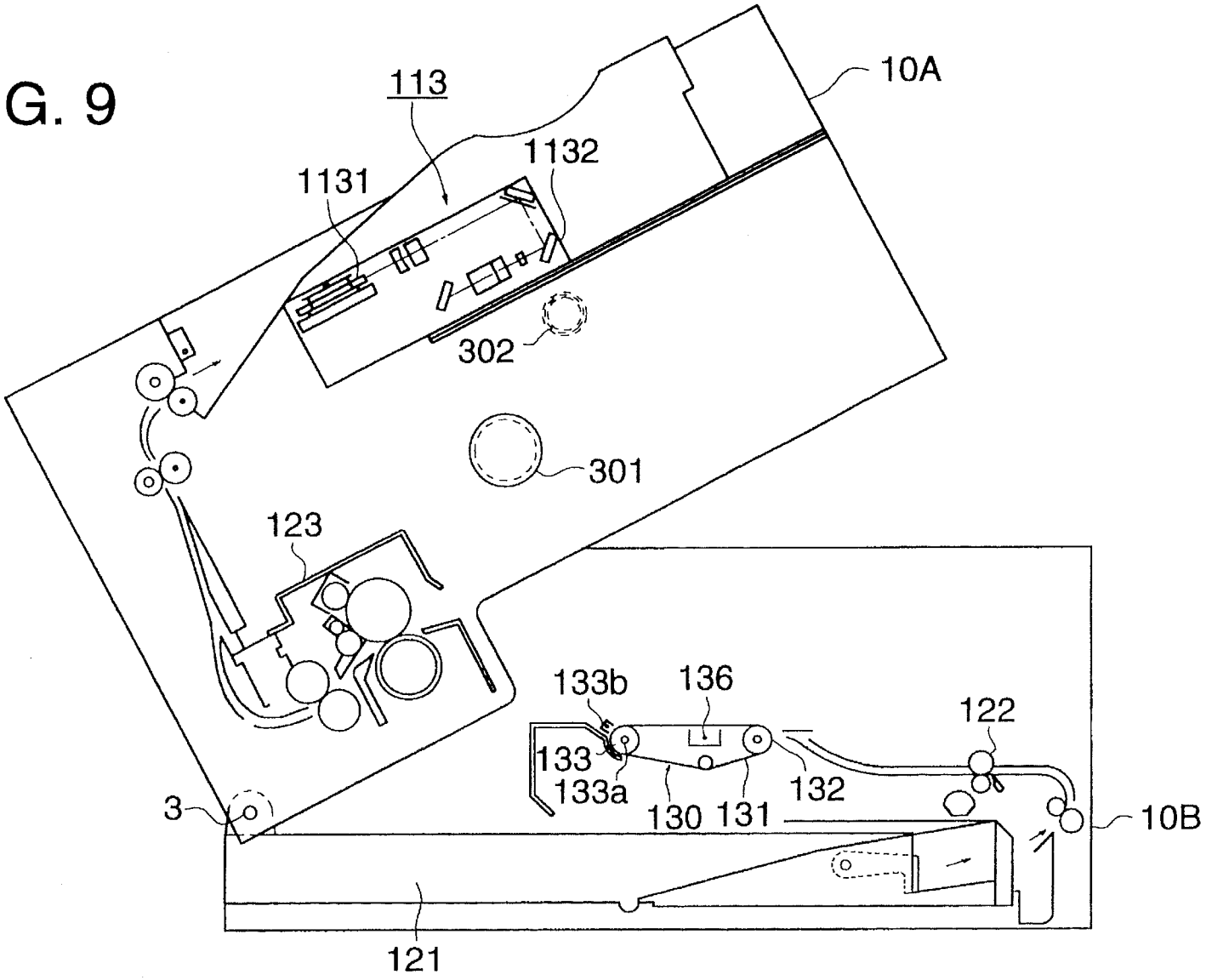
FIG. 9 is a sectional side view showing a condition in which the process cartridge and the color developing units are disengaged in FIG. 7.

In this example, when the process cartridge 2103 attached to the upper body 10A is opened together with the upper body 10A, black toner is replenished at the position to the toner replenishing port 204S of the black toner hopper 204H from an upper position of the main body 10A. The toner of Y, M and C are replenished to the color developing units 201, 202, 203 in the following manner:

In the case where the color developing units 201, 202,203 are formed into the color developing unit 2002, as illustrated in FIG. 8, the unit is integrally withdrawn from the photoreceptor drum 100 along the rail 12. Under the above condition, the toners are replenished to the toner replenishing ports 201S, 202S, 203S of the toner hoppers 201H, 202H, 203H of the developing units from an upper position.

The process cartridge 2103 is detachably provided so that it can be attached to and detached from the apparatus along the guide rail 11 of the upper body 10A. Accordingly, maintenance and cleaning of the overall color image forming apparatus can be easily carried out. The cartridge 2103 and the developing units are detached from the apparatus in a upper diagonal direction F. Therefore, the developing units can be prevented from being mistakenly dropped from the upper body 10A, and the operation can be stably conducted. Only when the upper body 10A is opened from the lower body 10B, jam clearance can be simply and positively conducted.

Next, with reference to the sectional side views of FIGS. 7 and 10, an example of the-third embodiment will be explained as follows.

This example is constructed in the following manner:

Only when the process cartridge 2103 is attached to the upper body 10A, a first lock not shown in the drawings is automatically unlocked. When an operator unlocks a second lock not shown in the drawings, the Y, M and C developing units 201, 202, 203 are detached from the cartridge 2103 or withdrawn from the photoreceptor drum 100. After the process cartridge 2103 has been detached from the upper body 10A, a retainer 142, shown schematically in FIGS. 7 and 10, prevents each of the developing units 102, 202, 203 from being detached from the process cartridge 2103. It is applicable to this embodiment that when the color developing units 201, 202, 203 are attached to the process cartridge 2103 detached from the apparatus and then the process cartridge is attached to the upper body 10A, the color developing units 201, 202, 203 can not be withdrawn from the photoreceptor drum 100. The reason why is the first lock is locked. In this embodiment, when detachment of the process cartridge 2103 is attempted from the upper body 10A while the color developing units 201, 202, 203 are withdrawn to the toner replenishing positions, a third lock mechanism 144, shown schematically in FIGS. 7 and 10 functions, so that the process cartridge 2103 can not be detached from the upper body 10A.

Figure 7:
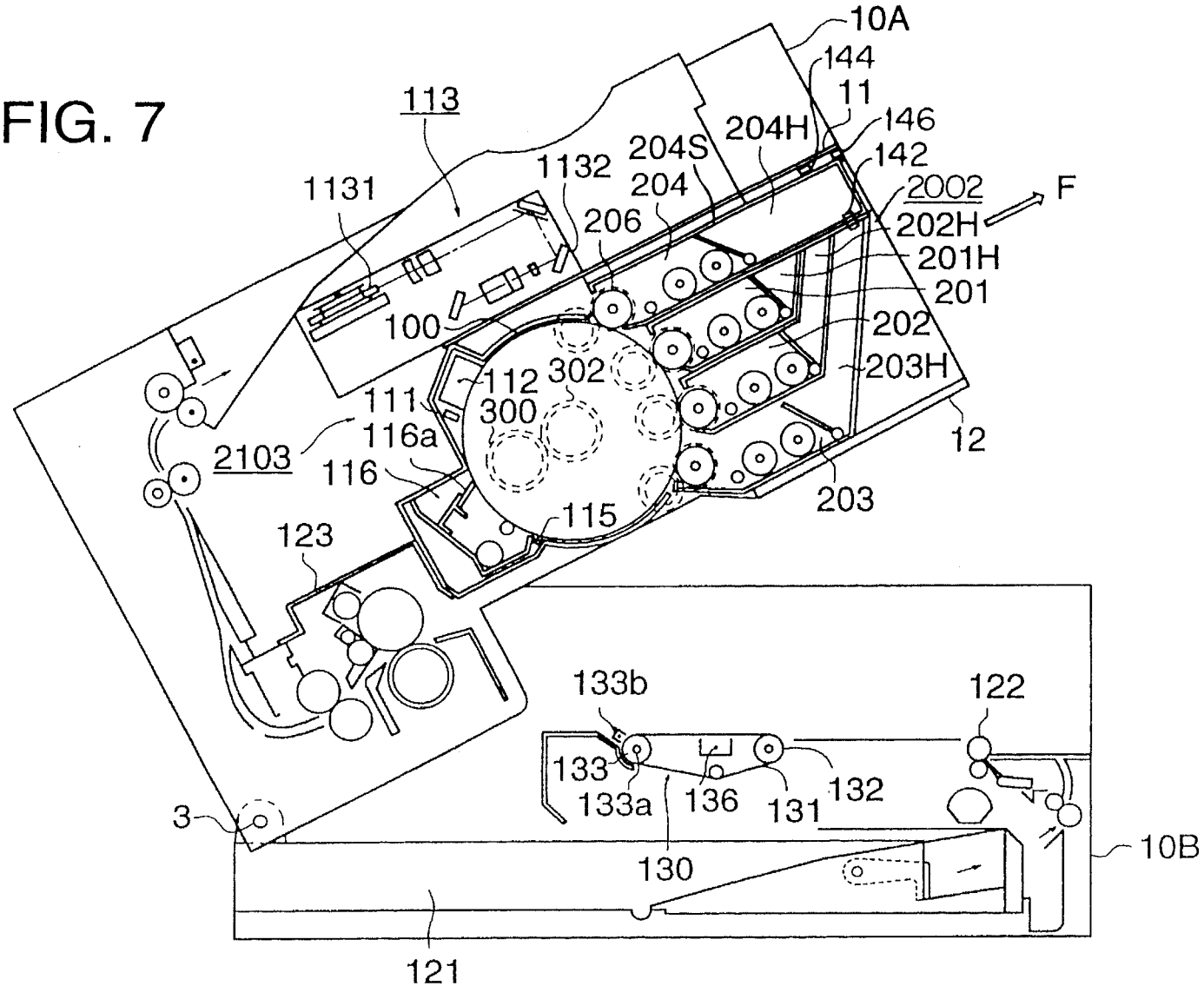
FIG. 7 is a sectional side view showing an open condition of another example of the color image forming apparatus of the present invention.
Figure 10:
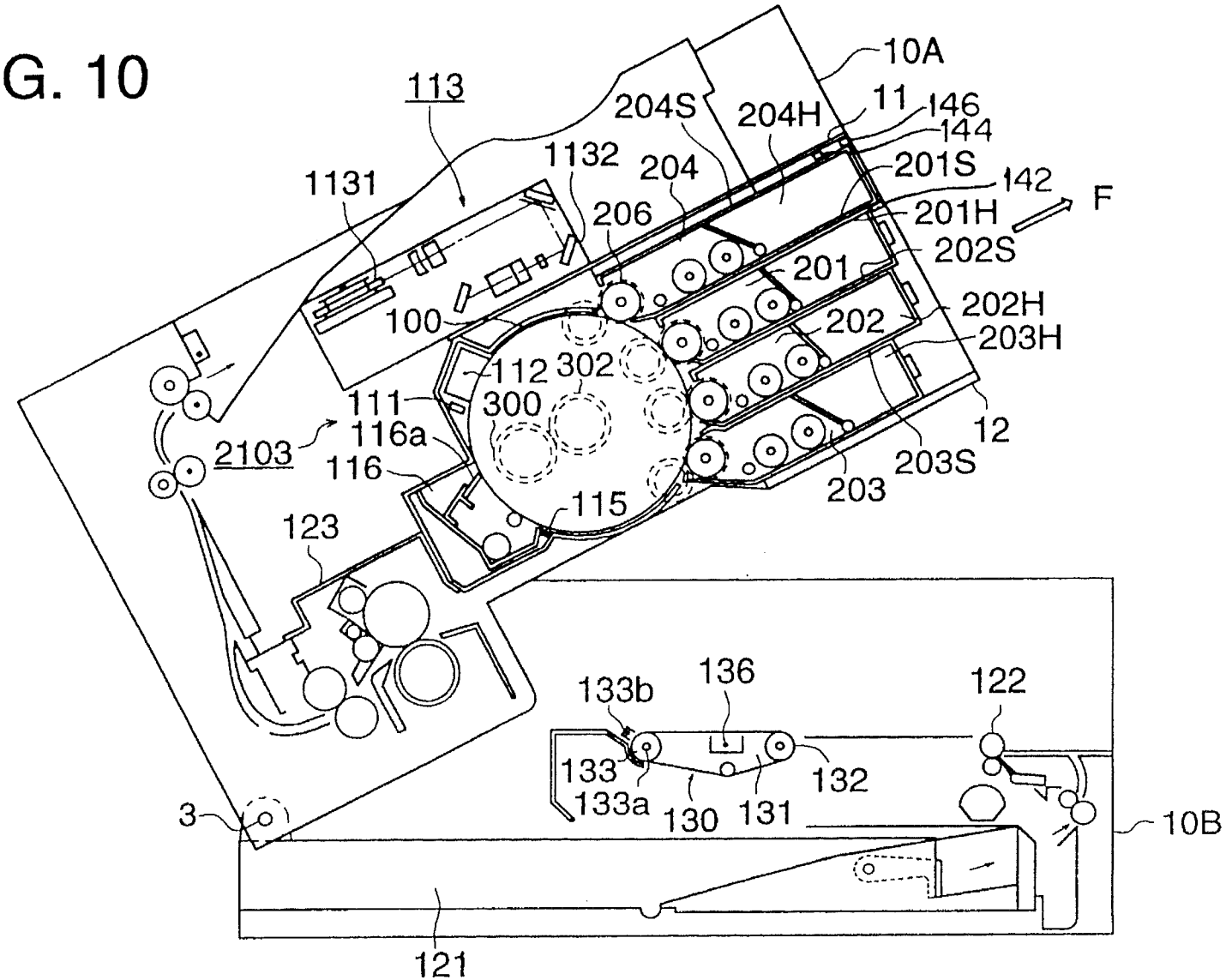
FIG. 10 is a sectional side view showing an open condition of another example of the color image forming apparatus of the present invention.
Figure 11:
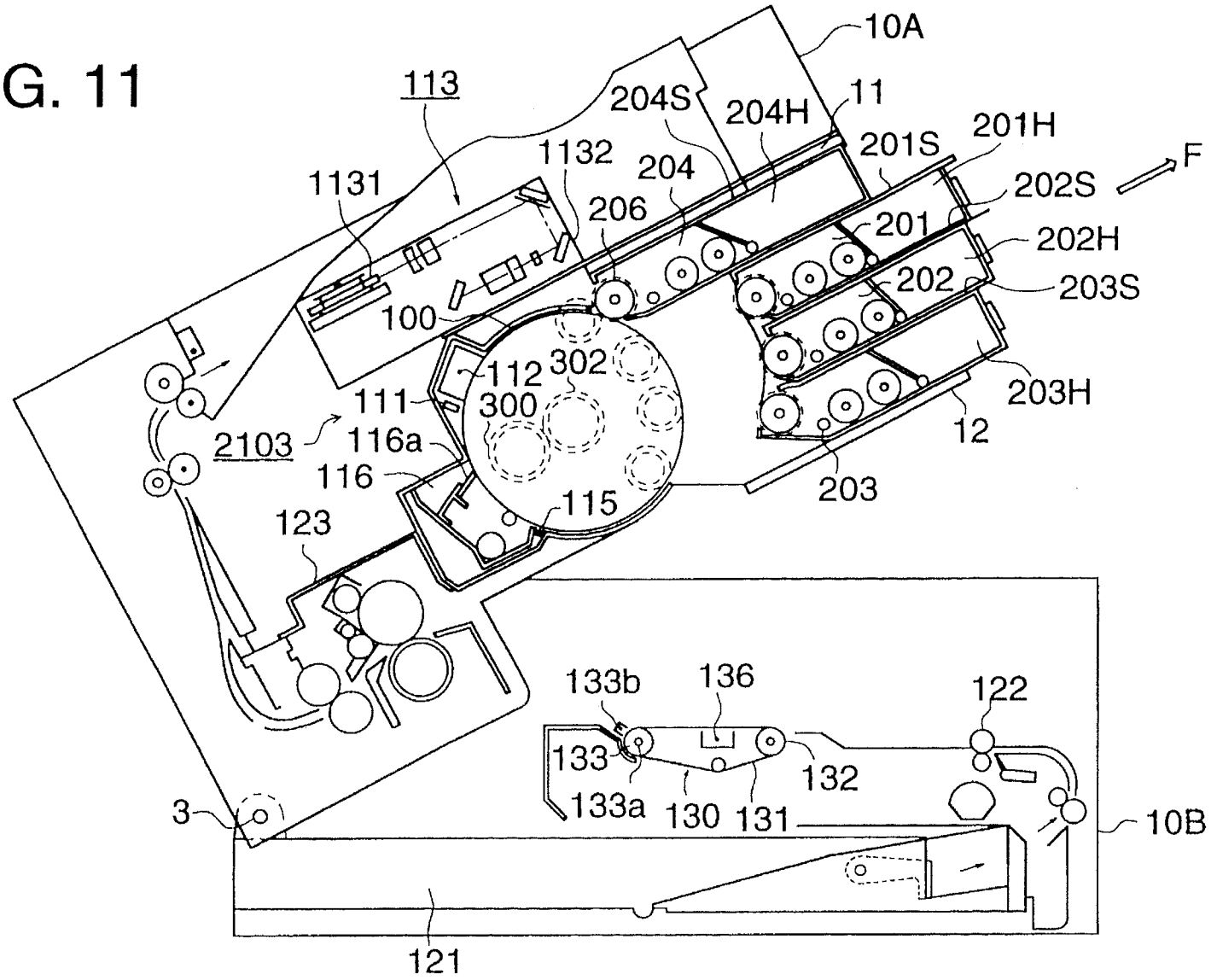
FIG. 11 is a sectional side view showing a condition in which the Y, M and C developing units are moved to an arbitrary position in FIG. 10.

In the above-mentioned third embodiment, when the Y, M and C developing units are attached to the process cartridge 2103 while the process cartridge 2103 is detached from the apparatus, an additional retainer 146, shown schematically in FIGS. 7 and 10, renders it impossible to attach the process cartridge 2103 to the upper body 10A if the developing units 201, 202, 203 are detached from the process cartridge 2103. The reason why is to prevent the occurrence of a problem in which a developing unit is mistakenly disengaged from the process cartridge detached from the apparatus and the surrounding components are stained with toner.

Figure 3:
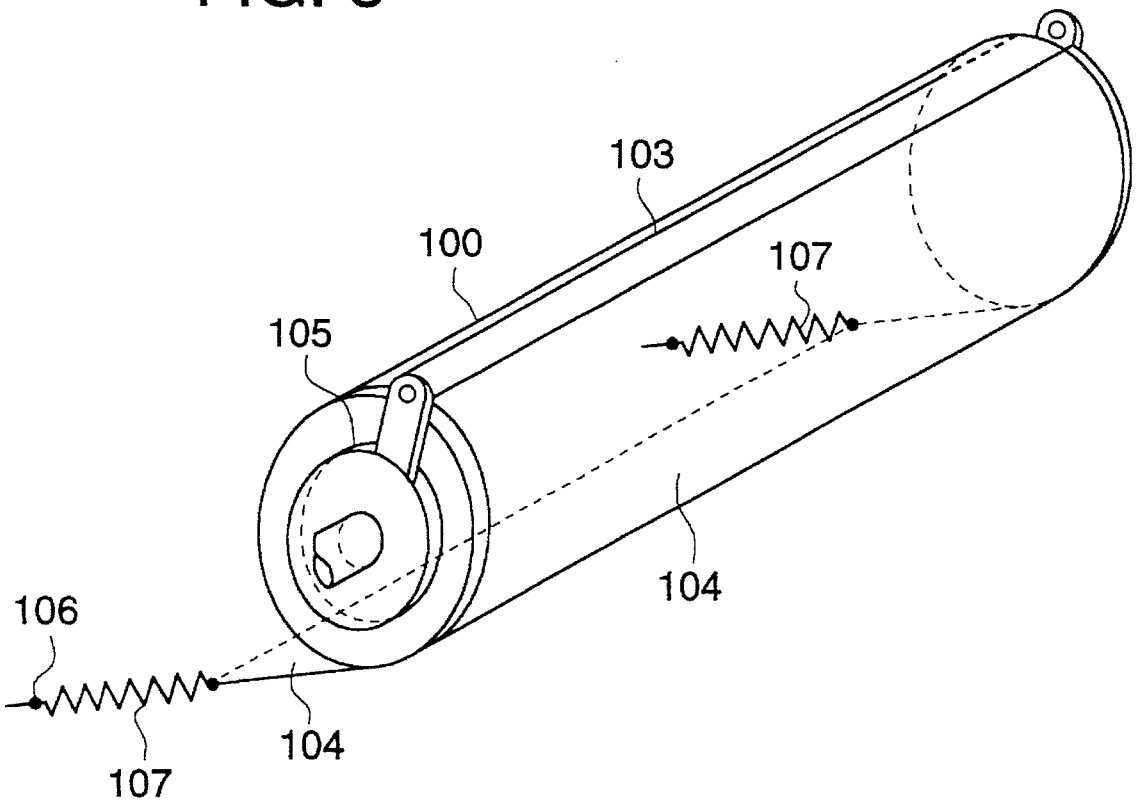
FIG. 3 is a perspective view of the shading device of the photoreceptor drum.
Figure 4:
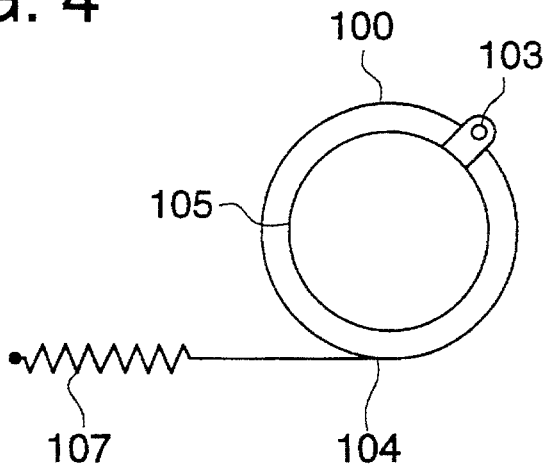
FIG. 4 is a side view of FIG. 3.
Figure 5:
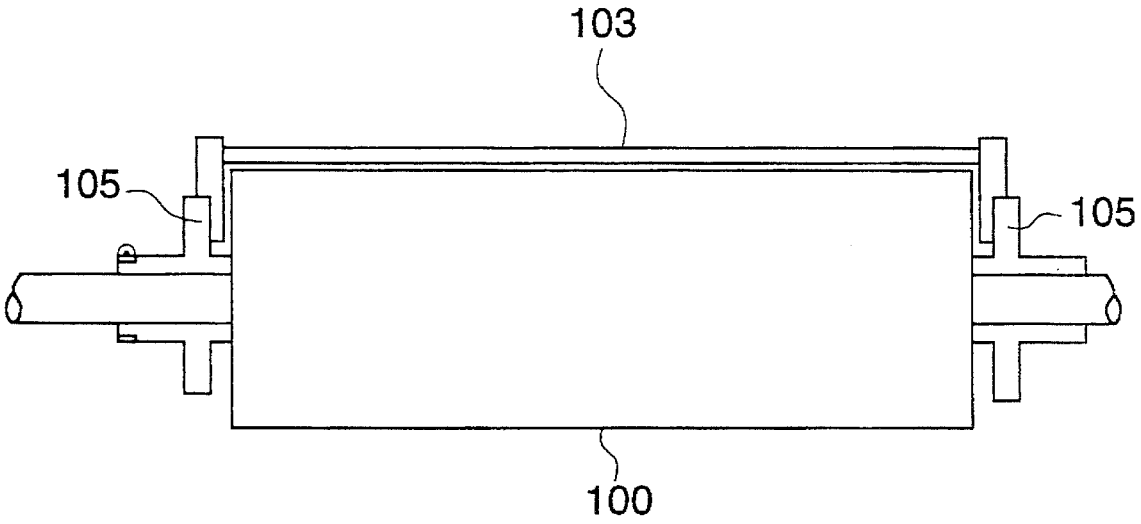
FIG. 5 is a front view of FIG. 3.
Figure 6:
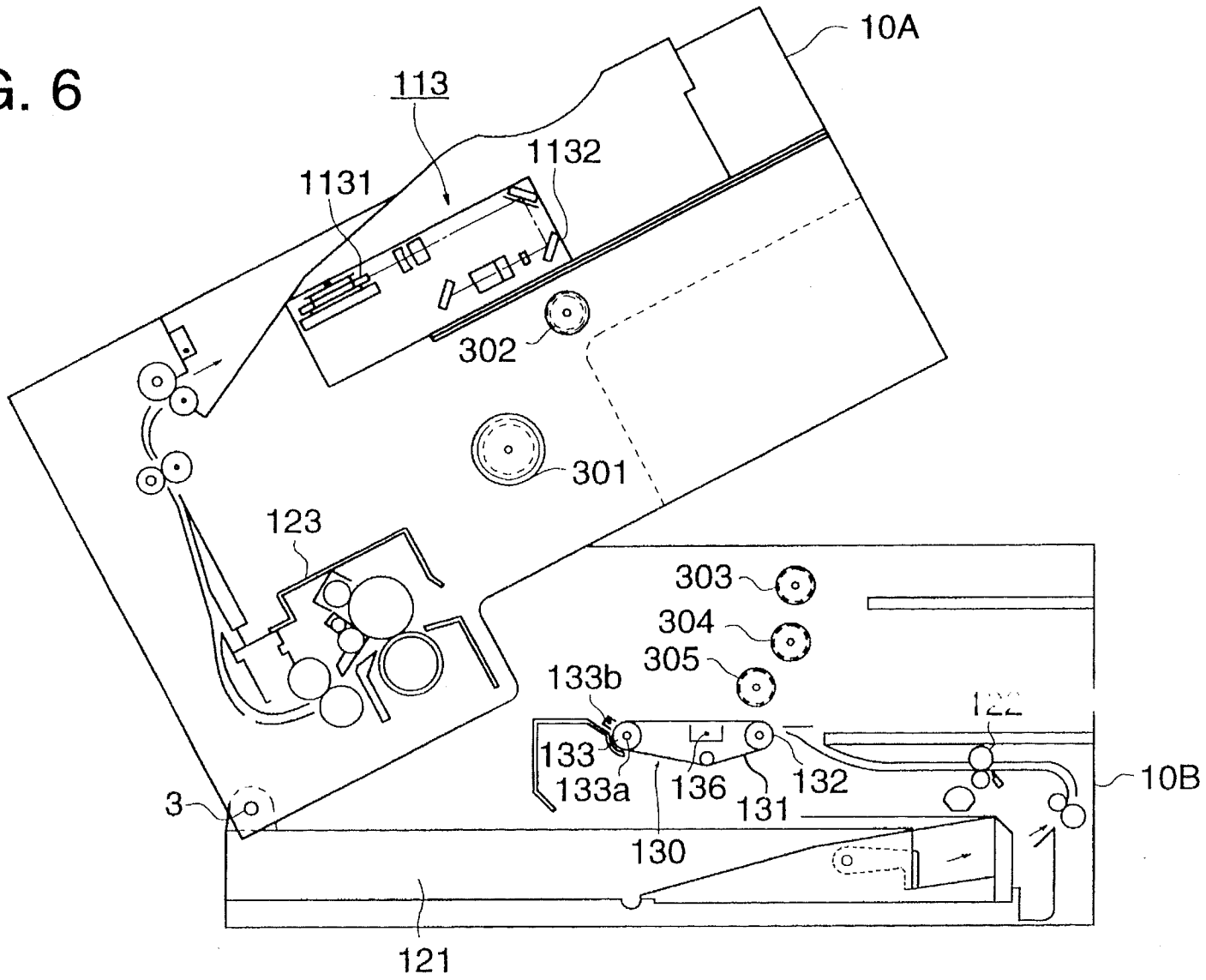
FIG. 6 is a sectional side view showing a condition in which the process cartridge and developing units are disengaged under an open condition of the example of the color image forming apparatus of the present invention.

In the fourth embodiment, in the case where the process cartridge 2103 is attached to the opened upper body 10A and then the Y, M and C developing units 201, 202, 203 are withdrawn and detached from the apparatus, the shading curtains 104 shown in FIGS. 3, 4 and 5 are closed so that the deterioration of the photoreceptor drum can be prevented and further protected from dust.

Figure 12:
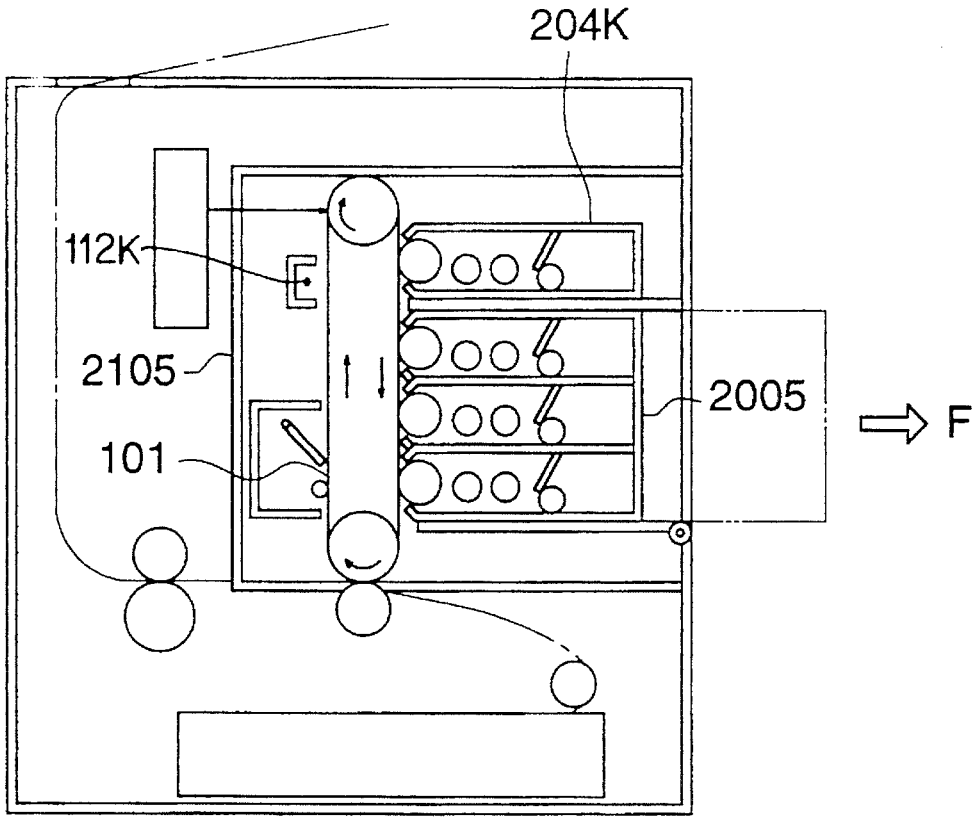
FIG. 12(*a*) is a sectional side view of the example of the present invention in which a photoreceptor belt is used for the image forming body.
Figure 12:
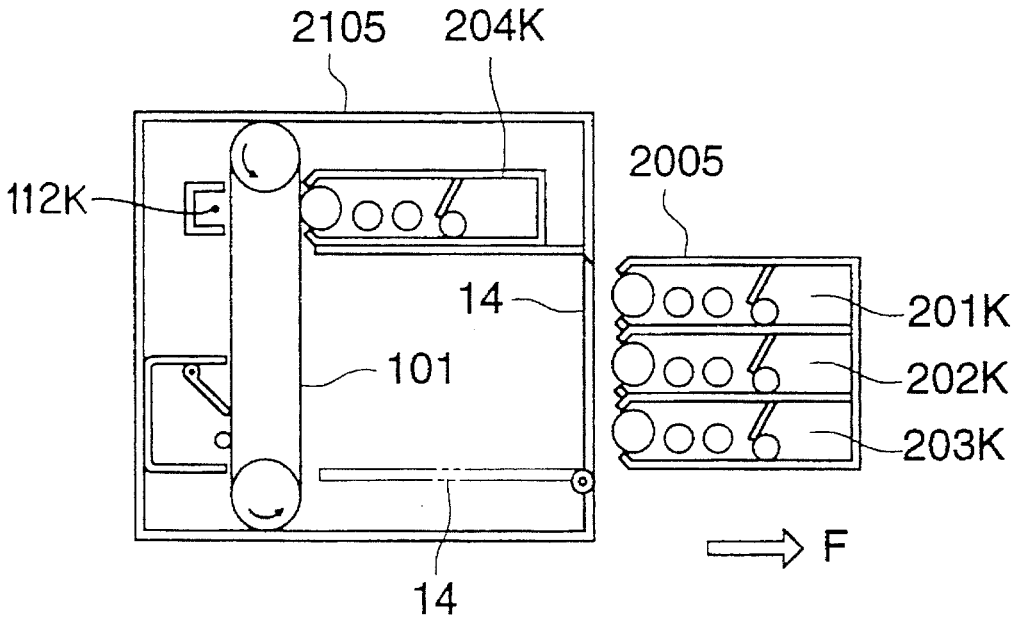

As shown in the side views of FIGS. 12(*a*), 12(*b*), 13(*a*), and 13(*b*), even when the image forming body is composed of a photoreceptor belt 101, the process cartridge 2105 can be organized. That is, the Y, M and C color developing units are independently or integrally formed into a color developing unit 2005, and they can be detached in the case of toner supply, jam clearance and maintenance. Also, the process cartridge 2105 to which the photoreceptor belt 101, the black developing unit 204K and the charger 112K are assembled can be detached from the image forming apparatus 10K, so that toner supply, maintenance and cleaning can be easily and positively carried out.

The attaching and detaching directions of the process cartridge and color developing unit are the same, which is indicated by the character F in the drawing, and further the operation is simple. In the same manner as that shown in the side view of FIG. 9 in which the drive mechanism is connected with the drive gears 301, 302 in the process of attachment and detachment of the process cartridge including the photoreceptor drum 100, the connection can be simply and positively made in the process of attachment and detachment of the process cartridge including the photoreceptor belt 101. As a means for preventing the deterioration of the photoreceptor belt 101 caused by light, as illustrated in FIGS. 12(*b*) and 13(*b*), when the color developing unit 2005 is disengaged, the shading door 14 of the cartridge is closed by a pushing spring not shown in the drawing, so that the surface of the photoreceptor belt 101 can be shaded.

Of course, when the color developing unit 2005 is attached to the process cartridge 2105, as illustrated in FIGS. 12(*a*) and 12(*b*), the opening and closing door 14 is laid horizontally. In this case, the photoreceptor belt 101 is shaded by the color developing unit itself, so that the deterioration of the photoreceptor belt 101 caused by light can be prevented.

Figure 13:
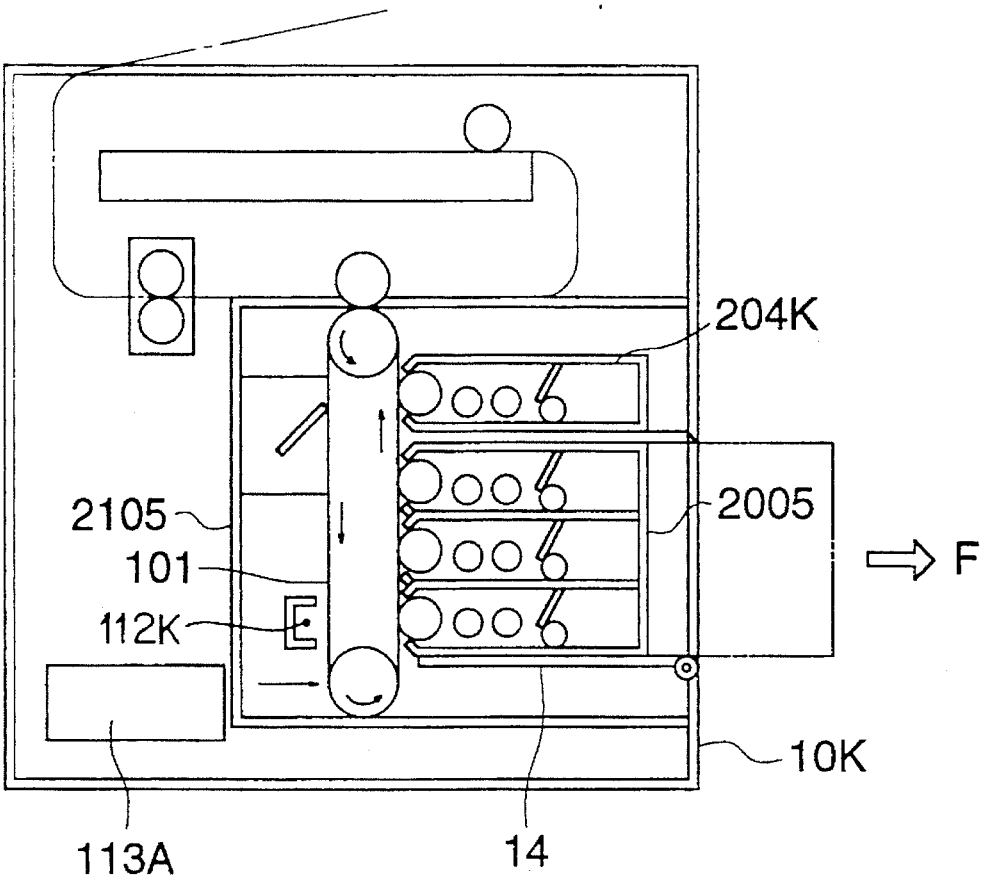
FIG. 13(*a*) is a sectional side view of another example of the present invention in which a photoreceptor belt is used for the image forming body.
Figure 13:
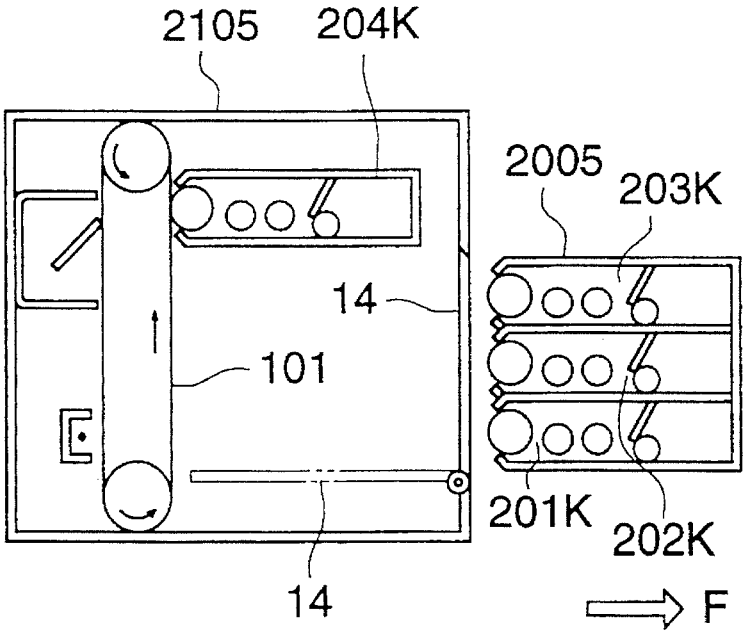

In this case, the constructions of the image forming apparatus shown in FIGS. 12 and 13 in which the photoreceptor belt is used, the construction of the image forming apparatus shown in FIGS. 12 can be applied to the first and the second embodiments explained before using the photoreceptor drum, and in the same manner, the construction shown in FIGS. 13(*a*) and 13(*b*) can be applied to the second embodiment.

When the Y, M and C color developing units are formed into a split type as shown in FIG. 2, the construction shown in FIG. 12(*a*) can be arranged in such a manner that the developing units including the process cartridge are withdrawn upward. Alternatively, the process cartridge is integrated with the Y, M and C developing units as shown in FIG. 7, and the process cartridge may be withdrawn upward. When the split construction is adopted as described above, the construction of the color image forming apparatus shown in FIGS. 2 and 7 in which the photoreceptor drum is used can be also applied to the construction in which the photoreceptor belt is used.

In the construction shown in FIG. 13(*a*), the sheet feed system is disposed at an upper position, however, it is relatively simple to open this sheet feed system upward. Due to the foregoing construction, it becomes possible to replenish toner to the black developing unit from an upper position. Therefore, the same function can be provided even when the process cartridge is not split in the manner shown in FIG. 7.

According to the first and the second embodiments, in the case of maintenance, inspection, cleaning or jam clearance, the process cartridge and developing units can be simply and positively detached. Therefore, the image forming apparatus can be provided, characterized in that: the image quality is steadily stabilized; the maneuverability is enhanced; and the equipment cost is low.

According to the third embodiment, a color image forming apparatus can be provided, characterized in that a predetermined developing unit is moved along the guide in one direction; and toner replenishing operation can be simply and positively carried out.

According to the fourth embodiment, the restriction is imposed when the process cartridge and the developing units are attached to and detached from the image forming apparatus, so that the developing units are prevented from being disengaged and further toner is prevented from overflowing. Therefore, the image forming apparatus is not stained with toner, and the environment can be maintained clean, and the productivity can be enhanced. As the common secondary effect, the light deterioration preventing device can be simplified, and the equipment cost can be reduced. Further, the maneuverability can be easily enhanced.

What is claimed is:

1. A color image forming apparatus for forming a color image on a recording medium, comprising:

a member having an upper body and a lower body;

an image retainer having a surface capable of retaining a toner image thereon;

charging means for charging said surface of said image retainer;

latent image forming means for forming a latent image on said surface when said charging means charges said surface;

black developing means for developing with black toner said latent image so as to form a black toner image, said image retainer and said black developing means forming a process cartridge detachably accommodated in said upper body;

color developing means, located in said upper body proximate to a first side of said upper body, for developing with a color toner said latent image so as to form a color toner image, said color developing means including a toner hopper for holding said color toner and a toner replenishing port formed in said toner hopper through which said color toner may be supplied to said toner hopper, said color developing means being detachable from said process cartridge so that said color toner may be supplied to said toner hopper through said toner replenishing port;

transferring means for transferring at least one of said black toner image and said color toner image from said surface of said image retainer to said recording medium;

conveyance means for conveying said recording medium to said transferring means;

cleaning means for cleaning residual toner on said surface of said image retainer after said transferring means transfers said at least one of said black toner image and said color toner image to said recording medium; and support means for pivotally supporting said upper body with respect to said lower body so that said upper body is movable upwards from a closed position in which said upper body is coupled with said lower body such that said color image forming apparatus is capable of forming a color image and an open position in which an open space forms between said transferring means and said image retainer, said support means including a hinge member pivotally connecting said upper body and said lower body, said hinge member being proximate to a second side of said upper body located opposite said first side of said upper body.

2. The color image forming apparatus of claim 1, comprising a plurality of color developing means each for developing with a respective color toner said latent image so as to form a respective color toner image.

3. The color image forming apparatus of claim 2, wherein each of said plurality of color developing means respectively forms one of yellow, magenta, and cyan toner images.

4. The color image forming apparatus of claim 3, wherein said plurality of color developing means are incorporated in a developing unit capable of being coupled with and uncoupled from said process cartridge.

5. The color image forming apparatus of claim 1, wherein said toner replenishing port of said color developing means is located in an upper portion of said color developing means.

6. The color image forming apparatus of claim 1, wherein said color developing means is detachably accommodated in said process cartridge so that when said upper body moves upward to said open position said color developing means may be detached from said process cartridge to permit supply of said color toner to said toner hopper through said toner replenishing port.

7. The color image forming apparatus of claim 6, wherein said color developing means is detachable together with said process cartridge from said upper body.

8. The color image forming apparatus of claim 7, further comprising means for limiting detachment of said process cartridge from said upper body when said color developing means is detached from said process cartridge.

9. A color image forming apparatus for forming a color image on a recording medium, comprising:

a member having an upper body and a lower body;

an image retainer having a surface capable of retaining a toner image thereon;

charging means for charging said surface of said image retainer;

latent image forming means for forming a latent image on said surface when said charging means charges said surface;

black developing means for developing with black toner said latent image so as to form a black toner image, said image retainer and said black developing means forming a process cartridge detachably accommodated in said upper body;

a plurality of color developing means each for developing with a respective color toner said latent image so that each of said plurality of color developing means respectively forms one of yellow, magenta, and cyan toner images, at least one of said plurality of color developing means including a toner hopper for holding said respective color toner and a toner replenishing port formed in said toner hopper through which said respective color toner may be supplied to said toner hopper, said plurality of color developing means being incorporated in a developing unit capable of being coupled with and uncoupled from said process cartridge, said developing unit being accommodated in said lower body;

transferring means for transferring at least one of said black, yellow, magenta, and cyan toner images from said surface of said image retainer to said recording medium;

conveyance means for conveying said recording medium to said transferring means;

cleaning means for cleaning residual toner on said surface of said image retainer after said transferring means transfers said at least one of said black, yellow, magenta, and cyan toner images to said recording medium; and support means for pivotally supporting said upper body with respect to said lower body so that said upper body is movable upwards from a closed position in which said upper body is coupled with said lower body such that said color image forming apparatus is capable of forming a color image and an open position in which an open space forms between said transferring means and said image retainer, said developing unit being detachable from said process cartridge when said upper body moves upward to said open position so that each of said plurality of color developing means may be supplied with said respective color toner.

10. A color image forming apparatus for forming a color image on a recording medium, comprising:

a member having an upper body and a lower body;

an image retainer having a surface capable of retaining a toner image the thereon;

charging means for charging said surface of said image retainer;

latent image forming means for forming a latent image on said surface when said charging means charges said surface;

black developing means for developing with black toner said latent image so as to form a black toner image, said image retainer and said black developing means forming a process cartridge detachably accommodated in said upper body;

color developing means for developing with a color toner said latent image so as to form a color toner image, said color developing means including a toner hopper for holding said color toner and a toner replenishing port formed in said toner hopper through which said color toner may be supplied to said toner hopper;

transferring means for transferring at least one of said black toner image and said color toner image from said surface of said image retainer to said recording medium;

conveyance means for conveying said recording medium to said transferring means;

cleaning means for cleaning residual toner on said surface of said image retainer after said transferring means transfers said at least one of said black toner image and said color toner image to said recording medium;

support means for pivotally supporting said upper body with respect to said lower body so that said upper body is movable upwards from a closed position in which said upper body is coupled with said lower body such that said color image forming apparatus is capable of forming a color image and an open position in which an open space forms between said transferring means and said image retainer, said color developing means being detachably accommodated in said process cartridge so that when said upper body moves upward to said open position said color developing means may be detached from said process cartridge to permit supply of said color toner to said toner hopper through said toner replenishing port; and means for limiting detachment of said color developing means from said process cartridge when said color developing means and said process cartridge are detached from said upper body.

11. A color image forming apparatus for forming a color image on a recording medium, comprising:

a member having an upper body and a lower body;

an image retainer having a surface capable of retaining a toner image thereon;

charging means for charging said surface of said image retainer;

latent image forming means for forming a latent image on said surface when said charging means charges said surface;

black developing means for developing with black toner said latent image so as to form a black toner image, said image retainer and said black developing means forming a process cartridge detachably accommodated in said upper body;

color developing means for developing with a color toner said latent image so as to form a color toner image, said Color developing means including a toner hopper for holding said color toner and a toner replenishing port formed in said toner hopper through which said color toner may be supplied to said toner hopper;

transferring means for transferring at least one of said black toner image and said color toner image from said surface of said image retainer to said recording medium;

conveyance means for conveying said recording medium to said transferring means;

cleaning means for cleaning residual toner on said surface of said image retainer after said transferring means transfers said at least one of said black toner image and said color toner image to said recording medium;

support means for pivotally supporting said upper body with respect to said lower body so that said upper body is movable upwards from a closed position in which said upper body is coupled with said lower body such that said color image forming apparatus is capable of forming a color image and an open position in which an open space forms between said transferring means and said image retainer, said color developing means being detachably accommodated in said process cartridge so that when said upper body moves upward to said open position said color developing means may be detached from said process cartridge to permit supply of said color toner to said toner hopper through Said toner replenishing port; and means for limiting coupling of said process cartridge with said upper body when said color developing means is detached from said process cartridge.

* * * * *